US009380891B2

(12) United States Patent
Wittenberg et al.

(10) Patent No.: US 9,380,891 B2
(45) Date of Patent: Jul. 5, 2016

(54) OVER-THE-DOOR STORAGE ARMOIRE

(71) Applicant: Target Brands, Inc., Minneapolis, MN (US)

(72) Inventors: Katherine R. Wittenberg, St. Paul, MN (US); Sarah E. Wray, Minneapolis, MN (US); Jordan A. Hinkley, Minneapolis, MN (US); Bradley S. Kerl, Dane, WI (US); Jason A. Thompson, Mount Horeb, WI (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/456,414

(22) Filed: Aug. 11, 2014

(65) Prior Publication Data

US 2016/0037922 A1 Feb. 11, 2016

(51) Int. Cl.

| | |
|---|---|
| ***A47B 67/00*** | (2006.01) |
| ***A47G 1/00*** | (2006.01) |
| ***A47B 43/00*** | (2006.01) |
| ***A47B 97/00*** | (2006.01) |
| ***A47G 1/02*** | (2006.01) |

(52) U.S. Cl.

CPC ..... *A47G 1/00* (2013.01); *A47B 43/003* (2013.01); *A47B 97/00* (2013.01); *A47G 1/02* (2013.01)

(58) Field of Classification Search

CPC ..... A47B 67/005

USPC ..... 312/215, 222, 227, 326–329; 248/214, 248/215

See application file for complete search history.

(56) References Cited

U.S. PATENT DOCUMENTS

| | | | | | |
|---|---|---|---|---|---|
| 345,020 | A | * | 7/1886 | Barney | F21V 21/08 248/214 |
| 1,222,963 | A | | 4/1917 | Matchette | |
| 1,721,953 | A | * | 7/1929 | Hendrickson | A47B 67/02 16/389 |
| 1,896,740 | A | * | 2/1933 | Cosseboom | H01F 27/06 248/214 |
| 1,980,730 | A | | 11/1934 | Matchette | |
| 2,807,515 | A | * | 9/1957 | Dean | A45C 15/06 132/288 |
| 4,247,070 | A | * | 1/1981 | Dirksing | E03D 9/038 248/215 |
| 5,141,300 | A | | 8/1992 | Ciesla | |
| D383,937 | S | | 9/1997 | Myers | |
| 5,681,100 | A | | 10/1997 | Powell | |

(Continued)

OTHER PUBLICATIONS

HSN, "Over-the-Door Beauty Armoire with Full-Length Mirror," http://www.hsn.com/products/over-the-door-beauty-armoire-with-full-length-mirror/7235941, at least as early as Apr. 2014, 1 page.

Houzz, "Over-the-Door Bath Storage," http://www.houzz.com/photos/401155/Over-the-Door-Bath-Storage-modern-storage-and-organization-, at least as early as Apr. 2014, 1 page.

(Continued)

*Primary Examiner* — Matthew Ing

(74) *Attorney, Agent, or Firm* — Leanne Taveggia Farrell; Westman, Champlin & Koehler, P.A.

(57) ABSTRACT

A storage armoire includes a back frame assembly configured to provide a storage space, a front frame assembly rotatably coupled to the back frame assembly so that the front frame assembly is pivotal about a portion of the back frame assembly and first and second over-the-door hangers. The first and second over-the-door hangers have hook portions that fit over a top of a door, mounting portions mounted to a back of the back frame assembly and arms extending between the mounting portions and the hook portions. The hook portions are spaced apart from each other on the door at a distance that is greater than a distance that the mounting portions that are mounted to the back of the back frame assembly are spaced apart from each other.

17 Claims, 19 Drawing Sheets

(56) References Cited

U.S. PATENT DOCUMENTS

| | | | | |
|---|---|---|---|---|
| 6,302,365 | B1 * | 10/2001 | Catanzarite | A47G 25/0614 248/215 |
| 6,375,018 | B1 | 4/2002 | Clement | |
| D479,659 | S | 9/2003 | Fleckenstein et al. | |
| 6,854,610 | B2 | 2/2005 | Adams | |
| D528,840 | S | 9/2006 | Greiner | |
| D555,392 | S | 11/2007 | Grozinger | |
| D557,939 | S | 12/2007 | Greiner | |
| 7,651,178 | B2 * | 1/2010 | Greiner | A47B 67/02 248/140 |
| 8,029,076 | B2 | 10/2011 | Greiner | |
| D667,235 | S | 9/2012 | Greiner | |
| D667,236 | S | 9/2012 | Greiner | |
| D667,237 | S | 9/2012 | Greiner | |
| D667,238 | S | 9/2012 | Greiner | |
| 8,342,470 | B2 | 1/2013 | Shortell | |
| D679,125 | S | 4/2013 | Livernois | |
| 8,534,627 | B2 | 9/2013 | Kressin | |
| D707,989 | S | 7/2014 | Bezborodko et al. | |
| D707,990 | S | 7/2014 | Bezborodko et al. | |
| D712,686 | S | 9/2014 | Day et al. | |
| 2006/0070892 | A1 | 4/2006 | Benson | |
| 2012/0223626 | A1 | 9/2012 | Thomas | |

OTHER PUBLICATIONS

Urban Outfitters, "Over-the-Door Vanity Station," http://www.urbanoutfitters.com/urban/catalog/productdetail.jsp?id=21067020#/, at least as early as Apr. 2014, 1 page.

Amazon, "Dalton Home Collection Over-the-Door/Wall Hanging Jewelry Armoire," http://www.amazon.com/Dalton-Home-Collection-Hanging-Jewelry/dp/B006B6IS38%3FSubscriptionId%3DAKIAIAA4MWUJXHBYFRNQ%26tag%3Dsquid1308080-20%26linkCode%3Dxm2%26camp%3D2025%26creative%3D165953%26creativeASIN%3DB006B6IS38, at least as early as Apr. 2014, 1 page.

Improvements, "Over the Door Jewelry Armoire," http://www.improvementscatalog.com/imp/278099?cm_mmc=GooglePLA-__-JewelryStorage-__-2014-__-441059&mr:trackingCode=B814D08C-1C75-E211-8FF3-001B21BCC0BC&mr:referralID=NA&mr:filter=31689823492&intlShippingCtx=US%7CUSD&codemacs=MP4XW091&mr:ad=17242509412&mr:device=c&mr:match=&SourceCode=MP4XW091&mr:adType=pla&mr:keyword=&redirect=y, at least as early as Apr. 2014, 1 page.

Office Action from Canadian Patent Application No. 2,868,961, mailed Jan. 16, 2015 (3 pages).

* cited by examiner

OVER-THE-DOOR STORAGE ARMOIRE

BACKGROUND

Doors can be used to support mirrors or storage-type articles including armoires and racks in bathrooms or bedrooms. Not only do doors provide a convenient mounting space, but the articles mounted to the doors are usually hung using over-the-door hangers, which eliminate placing anchors into walls in the bathroom or bedroom.

The discussion above is merely provided for general background information and is not intended to be used as an aid in determining the scope of the claimed subject matter.

SUMMARY

A storage armoire includes a back frame assembly configured to provide a storage space, a front frame assembly rotatably coupled to the back frame assembly so that the front frame assembly is pivotal about a portion of the back frame assembly and first and second over-the-door hangers. The first and second over-the-door hangers have hook portions that fit over a top of a door, mounting portions mounted to a back of the back frame assembly and arms extending between the mounting portions and the hook portions. The hook portions are spaced apart from each other on the door at a distance that is greater than a distance that the mounting portions that are mounted to the back of the back frame assembly are spaced apart from each other.

A storage unit includes a base frame member, a moveable frame member, a backer and an inner ring. The base frame member defines an opening and includes an integrally formed reactive portion of a latch. The moveable frame member defines an opening and is pivotally coupled to the base frame member. The backer is attached to an outer surface of the base frame member. The inner ring is fastened to an inside of the moveable frame member to secure a mirror to the moveable frame member and includes an integrally formed active portion of the latch. The active portion of the latch is configured to mate with the reactive portion of the latch so as to removably couple the moveable frame member to the base frame member.

A method is provided for hanging an article on a door. The method includes mounting a mounting portion of a first over-the-door hanger to a back of the article such that the mounting portion of the first over-the-hanger is located adjacent to a first side of the article. A mounting portion of a second over-the-door hanger is mounted to the back of the article such that the mounting portion of the second over-the-door hanger is located adjacent to a second side of the article that opposes the first side of the article. The hook portions of the first and second over-the-door hangers are hung over the top of the door. The hook portions are spaced apart from each other on the door a distance that is greater than a distance that the mounting portions are spaced apart from each other.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

An over-the-door storage armoire provides a space-saving alternative for storing and organizing items, such as jewelry, scarves, toiletries, etc. The storage armoire includes a back frame assembly and a front frame assembly rotatably coupled to the back frame assembly. The back frame assembly provides a storage space and the front frame assembly pivotally covers and uncovers the storage space. A pair of over-the-door hangers couple the back frame assembly and the front frame assembly to a door. The pair of over-the-door hangers include proximal ends, distal ends and arms that extend between the proximal and distal ends. The proximal ends are tool-lessly mounted to a back of the back frame assembly and the distal ends include U-shaped brackets for fitting on top of the door. To ensure that the back frame assembly and the front frame assembly do not swing back and forth when the front frame assembly is opened, a distance between the U-shaped brackets of the distal ends of the pair of over-the-door hangers is greater than a distance between the proximal ends of the pair of over-the-door hangers.

Figure 1:
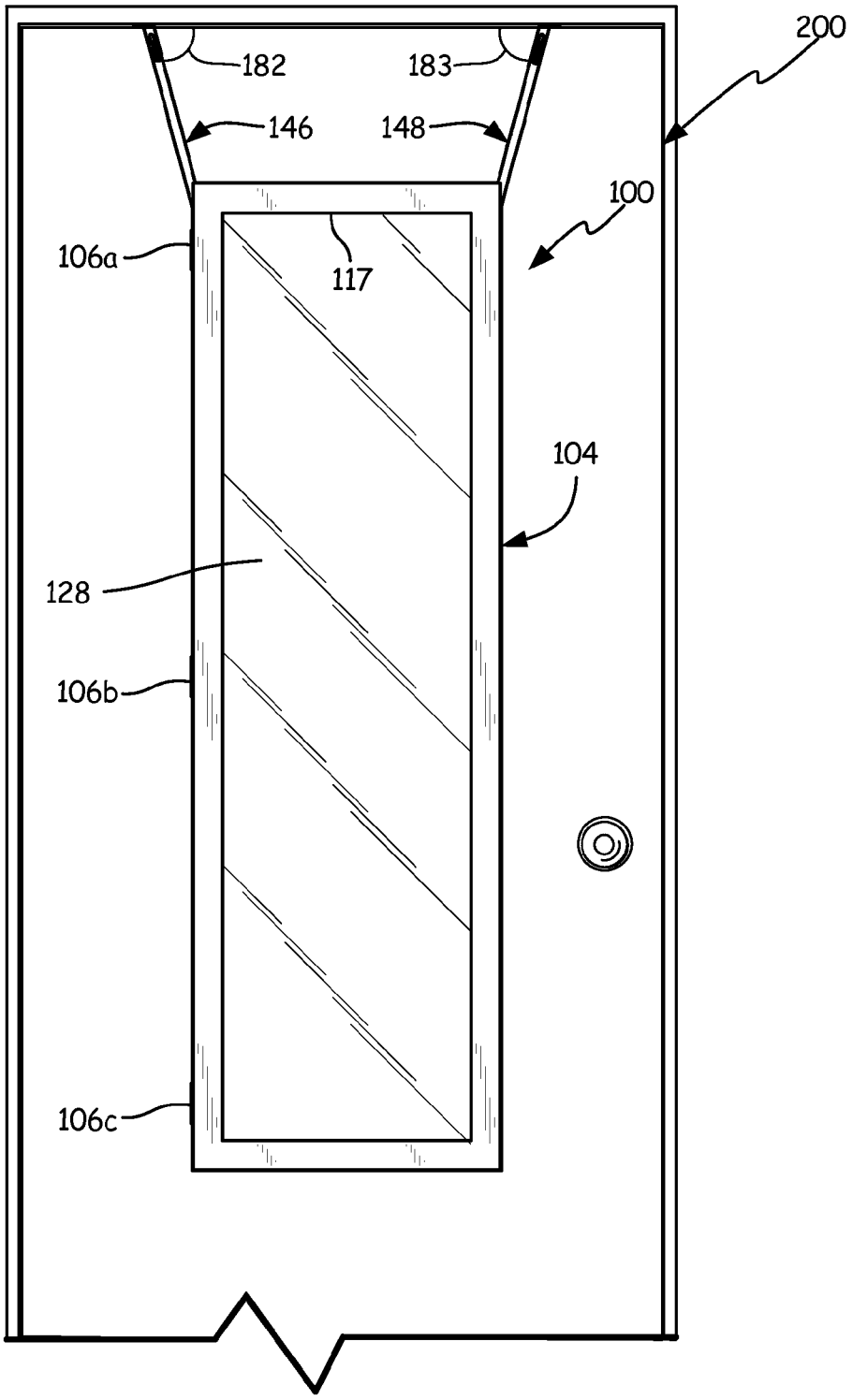
FIG. 1 is a front view of a storage armoire mounted to a door and in a closed position according to one embodiment.
Figure 2:
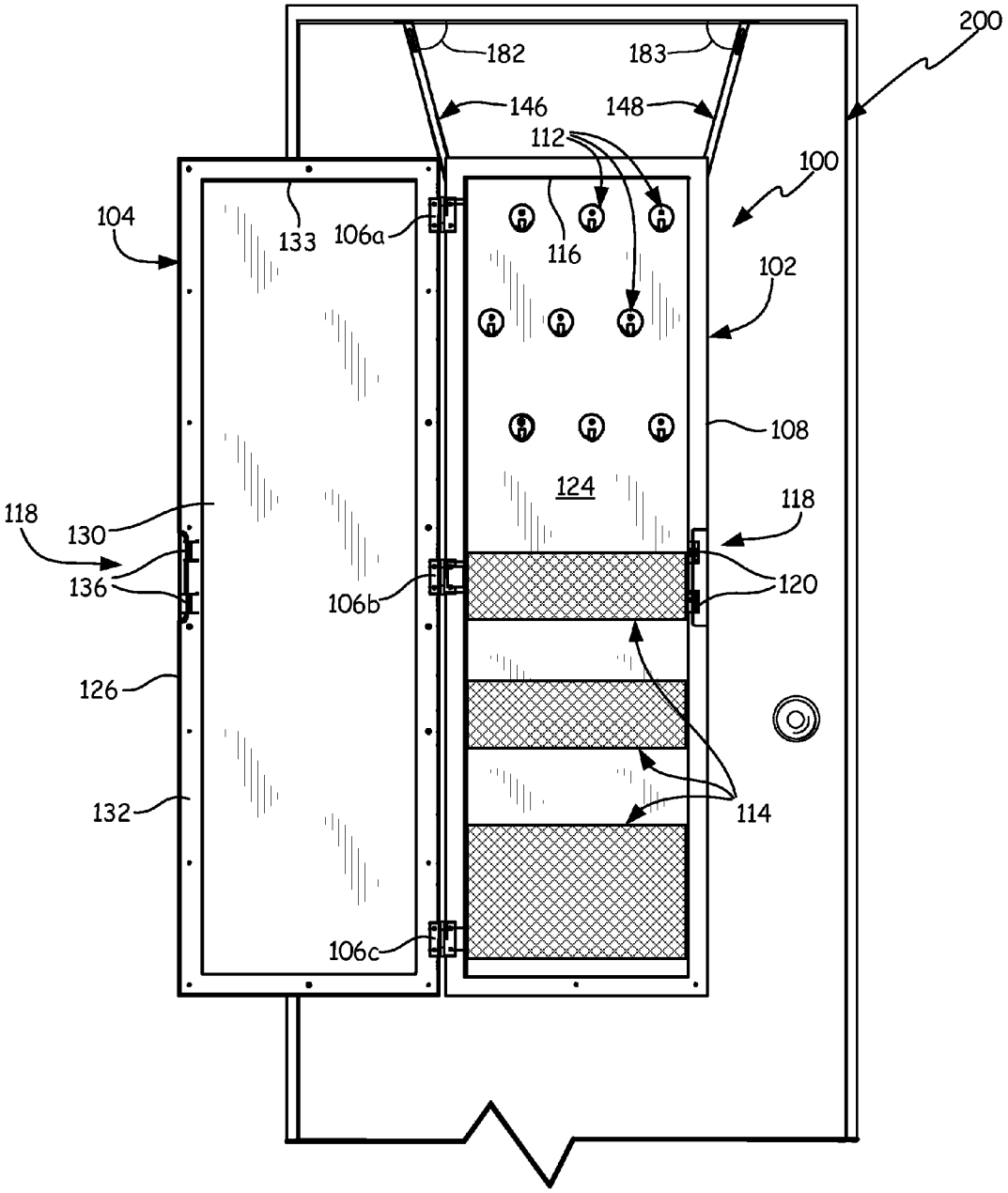
FIG. 2 is a front view of the storage armoire of FIG. 1 mounted to the door and in an opened position according to one embodiment.
Figure 17:
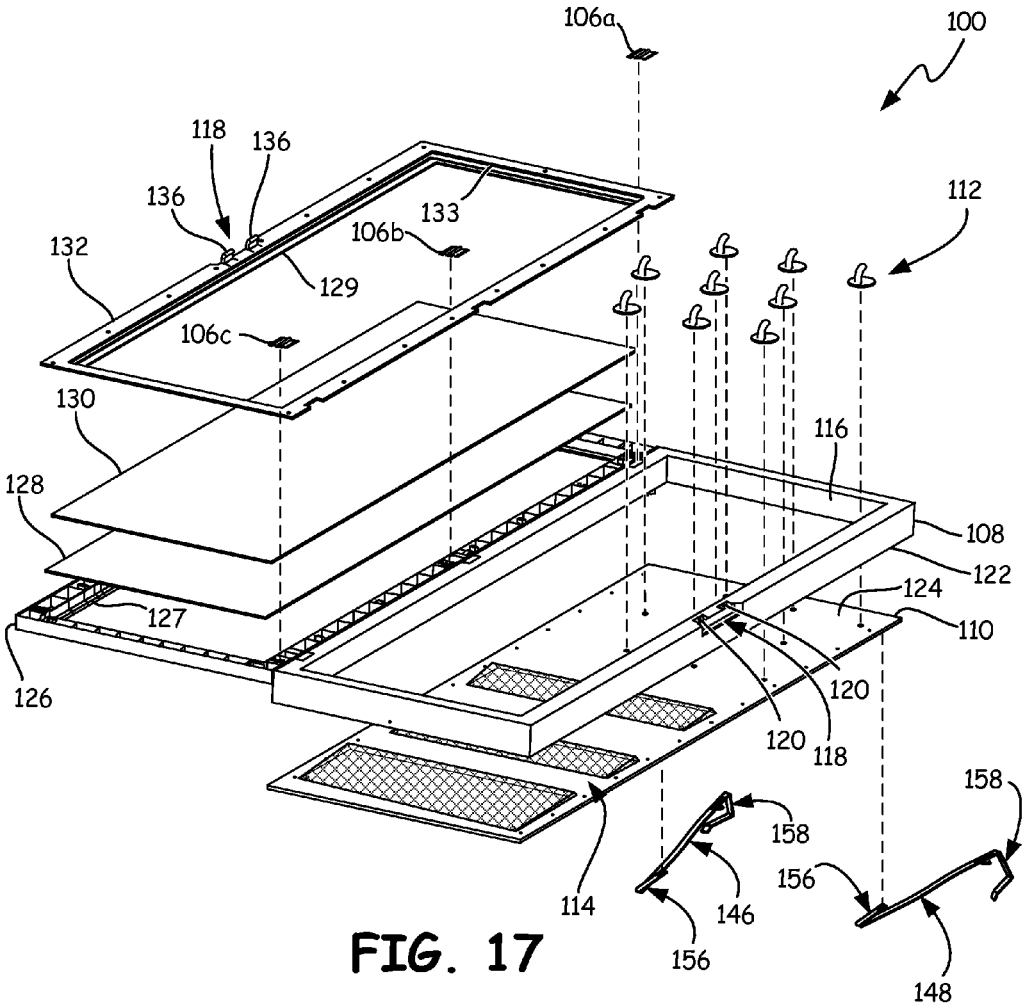
FIG. 17 is an exploded view of the storage armoire illustrated in FIGS. 1 and 2.

FIG. 1 is a front view of a storage armoire or unit 100 mounted to a door 200 and in a closed position according to one embodiment. FIG. 2 is a front view of storage armoire 100 mounted to door 200 and in an opened position according to one embodiment. FIGS. 3-10 are perspective and orthogonal views of storage armoire 100 in the closed position including a front perspective view, a back perspective view, a front view, a back view, a top view, a bottom view, a right side view and a left side view. FIGS. 11-16 are orthogonal views of storage armoire 100 in the opened position including a front view, a back view, a top view, a bottom view, a right side view and a left side view. FIG. 17 is an exploded view of storage armoire 100.

Storage armoire 100 includes a back frame assembly 102 and a front frame assembly 104 that is rotatably coupled to back frame assembly 102 so that front frame assembly 102 is pivotal about a portion of back frame assembly 102, by for example, a set of hinges 106*a*, 106*b* and 106*c* that are attached to back frame assembly 102 and correspondingly attached to front frame assembly 104. In particular, a left side of front frame assembly 104 is pivotal about a left side of back frame assembly 102 using hinges 106*a*, 106*b* and 106*c*, which are affixed to back frame assembly 102 and front frame assembly 104 by fasteners. Back frame assembly 102 provides storage space and storage components for storing items. Front frame assembly 104 provides a cover to cover the items being stored in back frame assembly 104.

Back frame assembly 102 includes a base frame member or inner profile 108, a backer 110 and a plurality of support components for storing and organizing items. In one embodiment, base frame member or inner profile 108 is made of injection molded polystyrene and includes a plurality of integrally molded boss features for receiving fasteners. Other types of materials and methods of manufacturing are possible. Base frame member 108 defines an opening 116 and includes an integrally formed reactive portion 120 of a latch 118. Latch 118 will be discussed in detail in regards to FIGS. 18-19.

Figure 11:
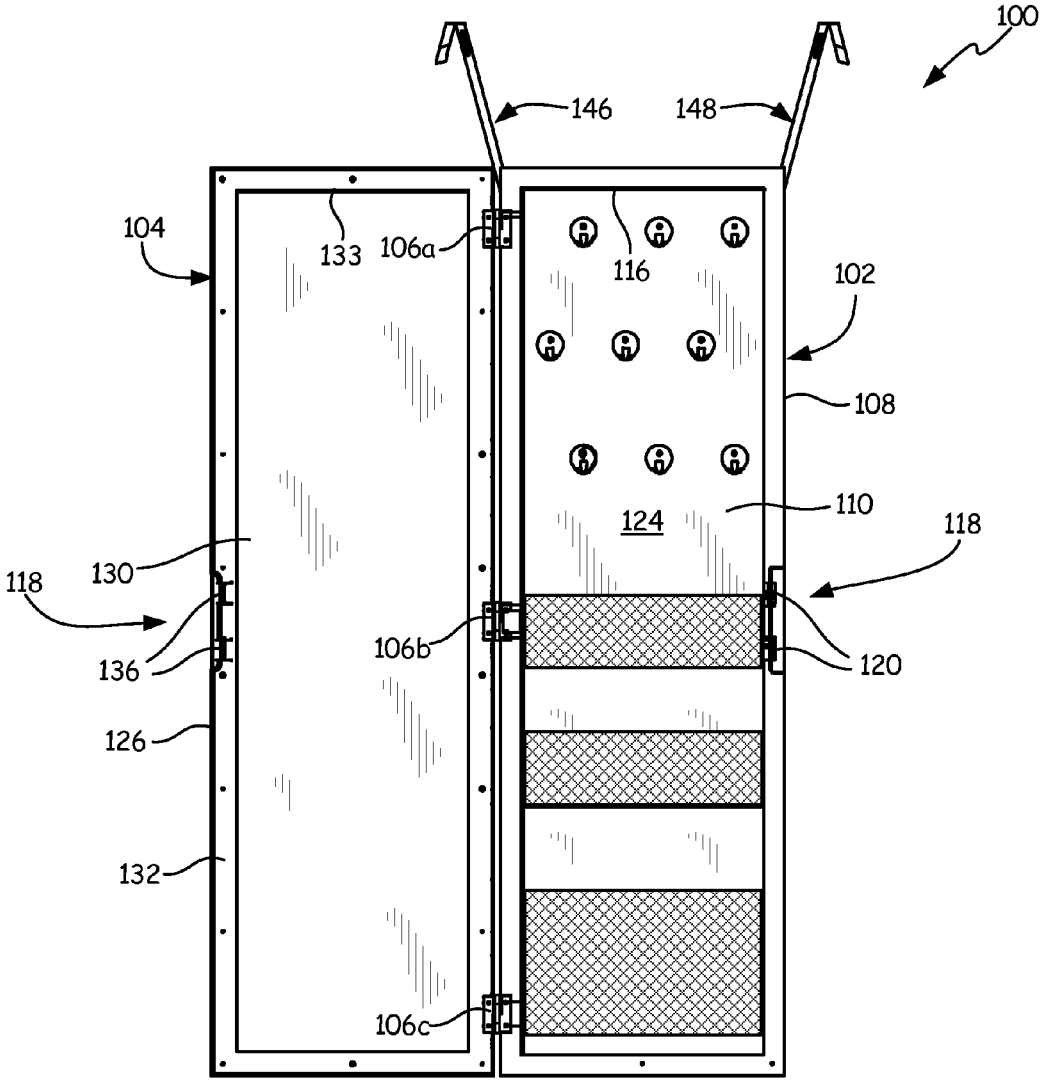
FIG. 11 is a front view of storage armoire illustrated in FIG. 2.

Backer 110 encloses opening 116 and is fastened or attached to a back or outer surface 122 of base frame member 108 using fasteners that are inserted into the boss features in base frame member 108. The plurality of support components are attached to a front surface 124 of backer 110. As illustrated in FIGS. 2, 11 and 17, support components attached to backer 110 include a plurality of hooks 112 and a plurality of pockets 114. In one embodiment, hooks 112 are fastened or attached to front surface 124 of backer 110 by, for example, rivets. The rivets are strong enough to hold up to three pounds and include a rust resistant coating. Pockets 114 are each made of a mesh fabric material that is secured to front surface 124 of backer 110 at the sides and bottoms of the pockets by, for example, rivets. In one embodiment, an elastic seam is placed at the top of the mesh material so as to hold and retain items that are placed within the pockets.

Front frame assembly 104 includes a moveable frame member or outer profile 126, a mirror 128, a mirror backer 130 and an inner ring 132 that is fastened to an inside of moveable frame member 126 to secure mirror 128 and mirror backer 130 to moveable frame member 126. In one embodiment, moveable frame member 126 is made of injection molded polystyrene and includes a plurality of integrally molded boss features for receiving fasteners and integrally molded ribs for added strength. Other types of materials and methods of manufacturing are possible. Moveable frame member 126 defines an opening 117 and includes an integrally formed inset 127 located adjacent to opening 117 and recessed from an inside of moveable frame member 126. Inset 127 provides an inner edge for locating mirror 128 and mirror backer 130 and a surface to which mirror 128 is adhesively coupled. Mirror 128 and mirror backer 130 enclose opening 117 in moveable frame member 126.

In one embodiment, inner ring 132 is made of an injection molded polypropylene. Other types of materials and methods of manufacturing are possible. Inner ring 132 defines an opening 133 and includes an inner lip 129 and an integrally formed active portion 136 of latch 118. Active portion 136 of latch 118 is configured to mate with reactive portion 120 of latch 118 so as to removably couple moveable frame member 126 to base frame member 108. Latch 118 will be discussed in detail in regards to FIGS. 18-19. Inner lip 129 of inner ring 132 presses mirror 128 and mirror backer 130 into inset 127 of moveable frame member 126 when fasteners are inserted through holes in inner ring 132 to secure inner ring 132 to moveable frame member 126.

Figure 9:
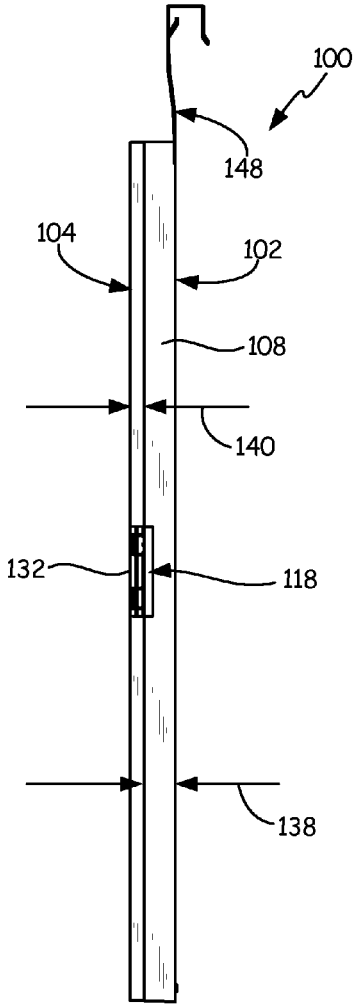
FIG. 9 is a right side view of the storage armoire illustrated in FIG. 1.
Figure 10:
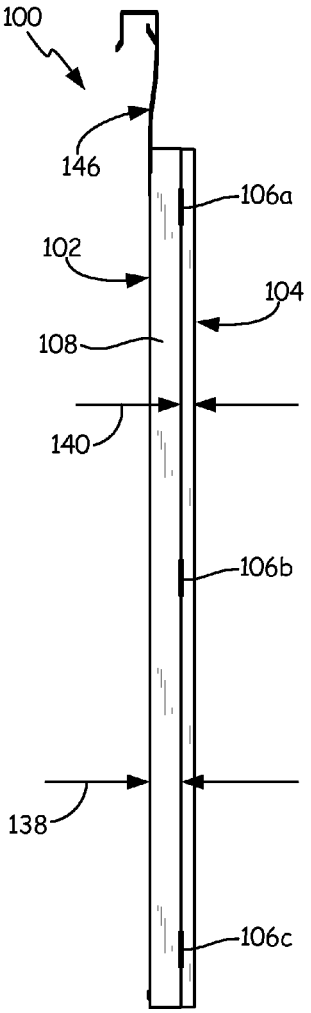
FIG. 10 is a left side view of the storage armoire illustrated in FIG. 1.

As illustrated in FIGS. 9 and 10, base frame member 108 of back frame assembly 102 includes a thickness 138 and moveable frame member 126 of front frame assembly 104 includes a thickness 140. Base frame member 108 is thicker than moveable frame member 126 so that base frame member 108 provides storage space for holding items. Moveable frame member 126 is thinner than base frame member 108 so that moveable frame member 126 provides a door or closure for the storage space.

Figure 3:
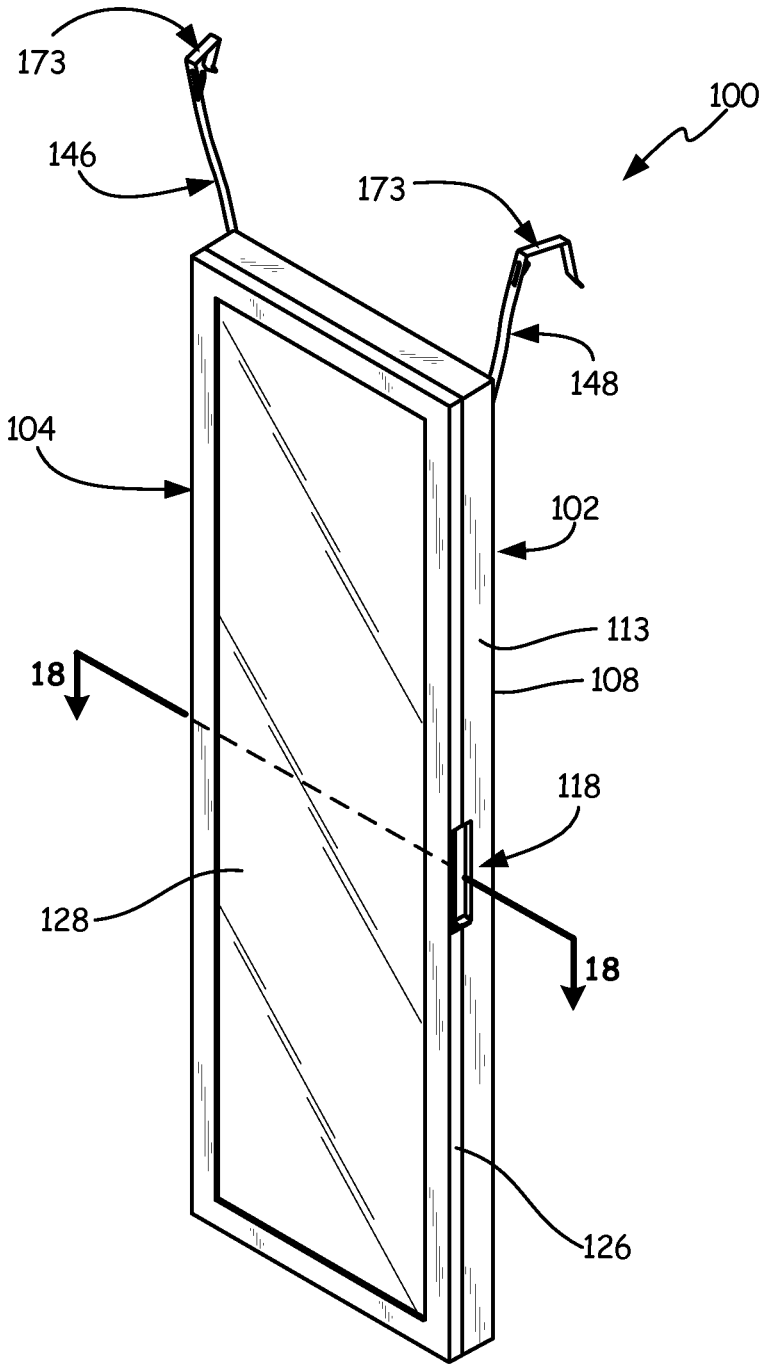
FIG. 3 is a front perspective view of the storage armoire illustrated in FIG. 1.
Figure 4:
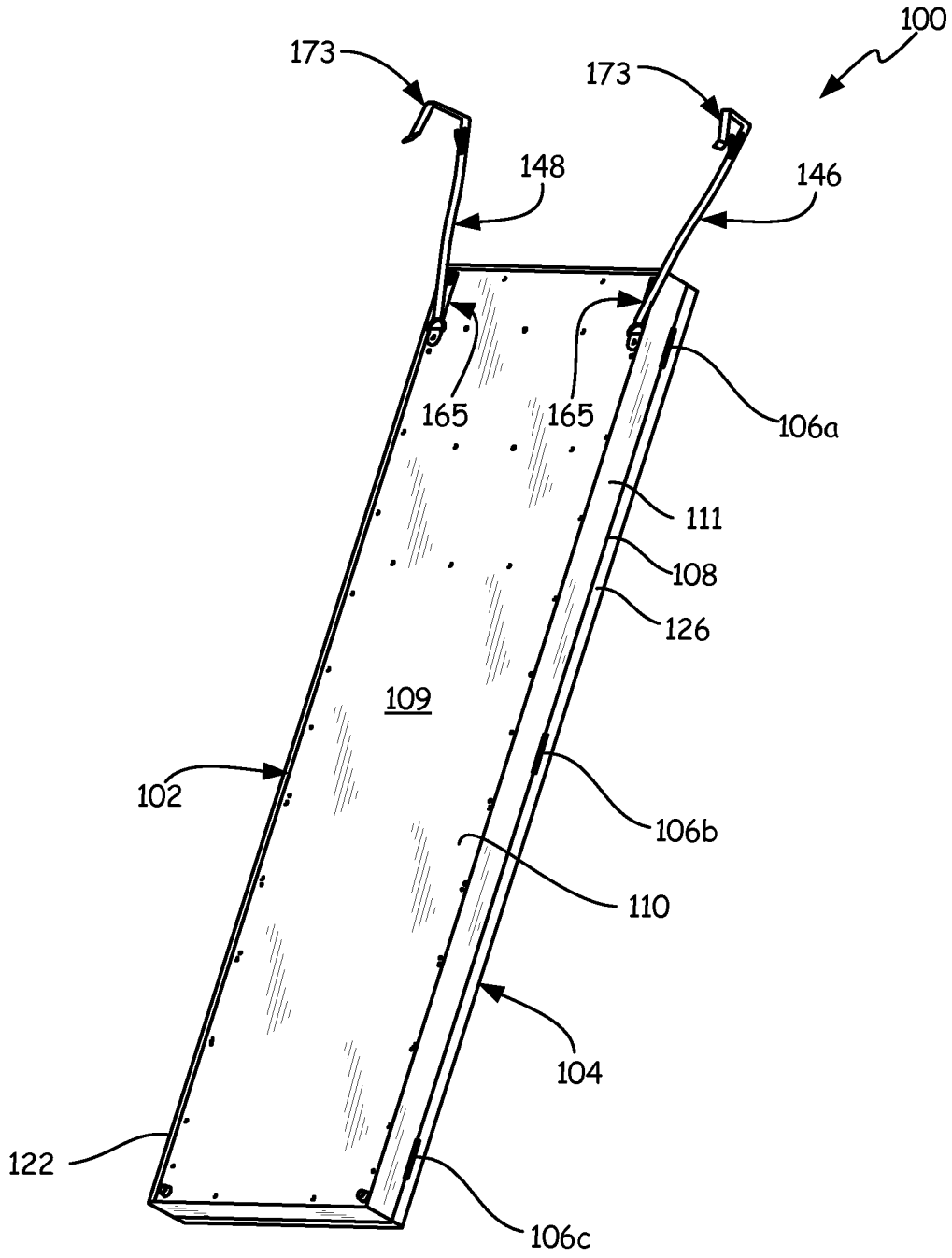
FIG. 4 is a back perspective view of the storage armoire illustrated in FIG. 1.
Figure 5:
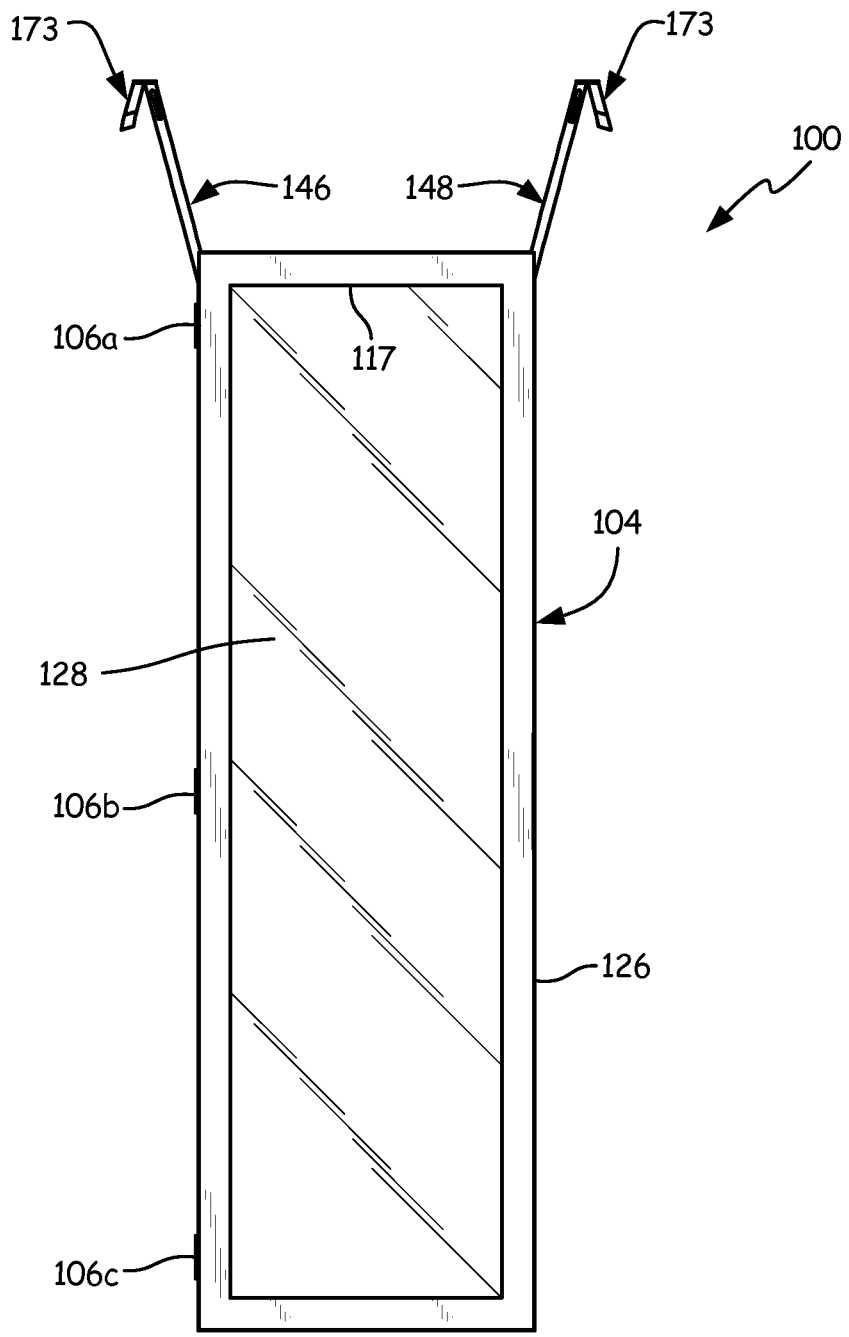
FIG. 5 is a front view of storage armoire illustrated in FIG. 1.
Figure 18:
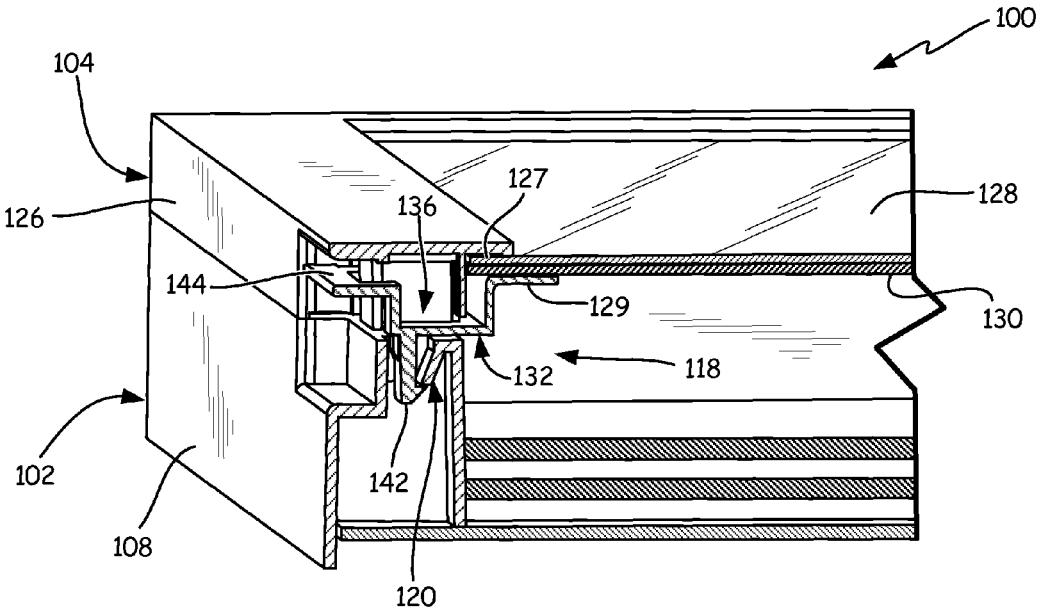
FIG. 18 is a partial section view of the storage armoire illustrated in FIGS. 1 and 2 as indicated in FIG. 3 with a latch in a locked position.
Figure 19:
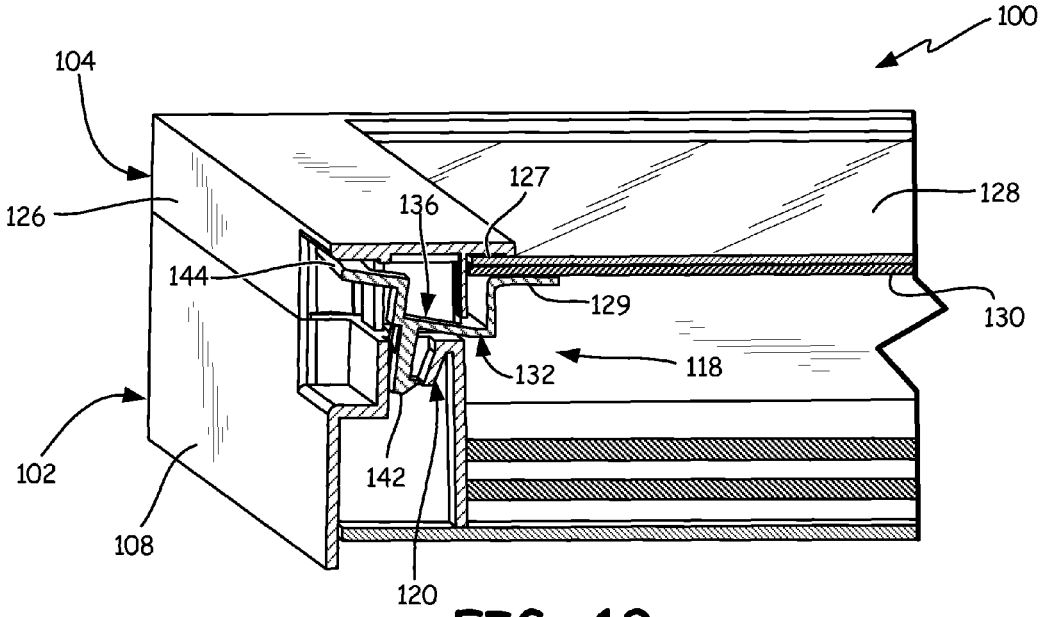
FIG. 19 is the partial section view of FIG. 18, but with the latch being in an unlocked position.
Figure 20:
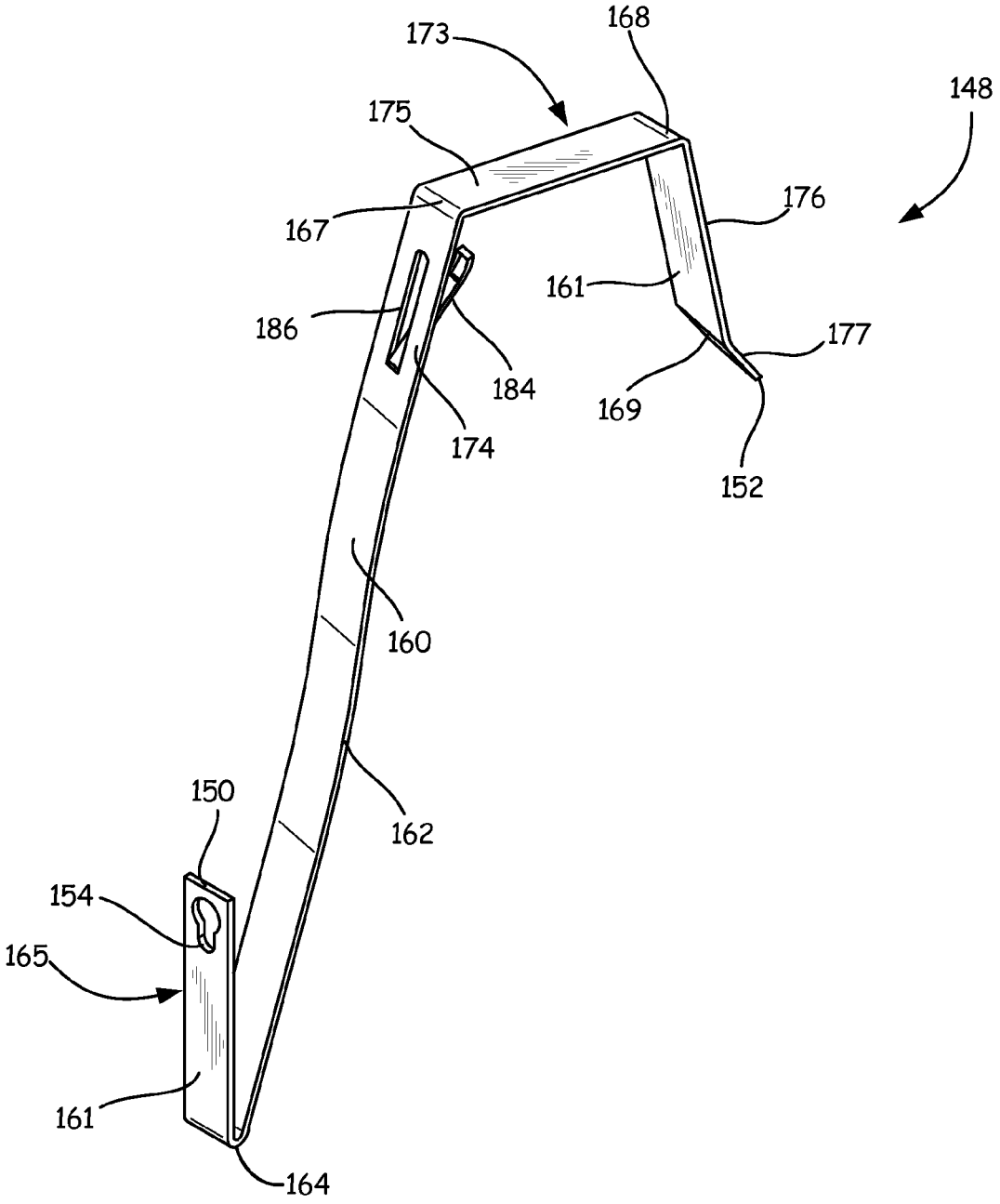
FIG. 20 is a perspective view of a first over-the-door hanger according to one embodiment.
Figure 21:
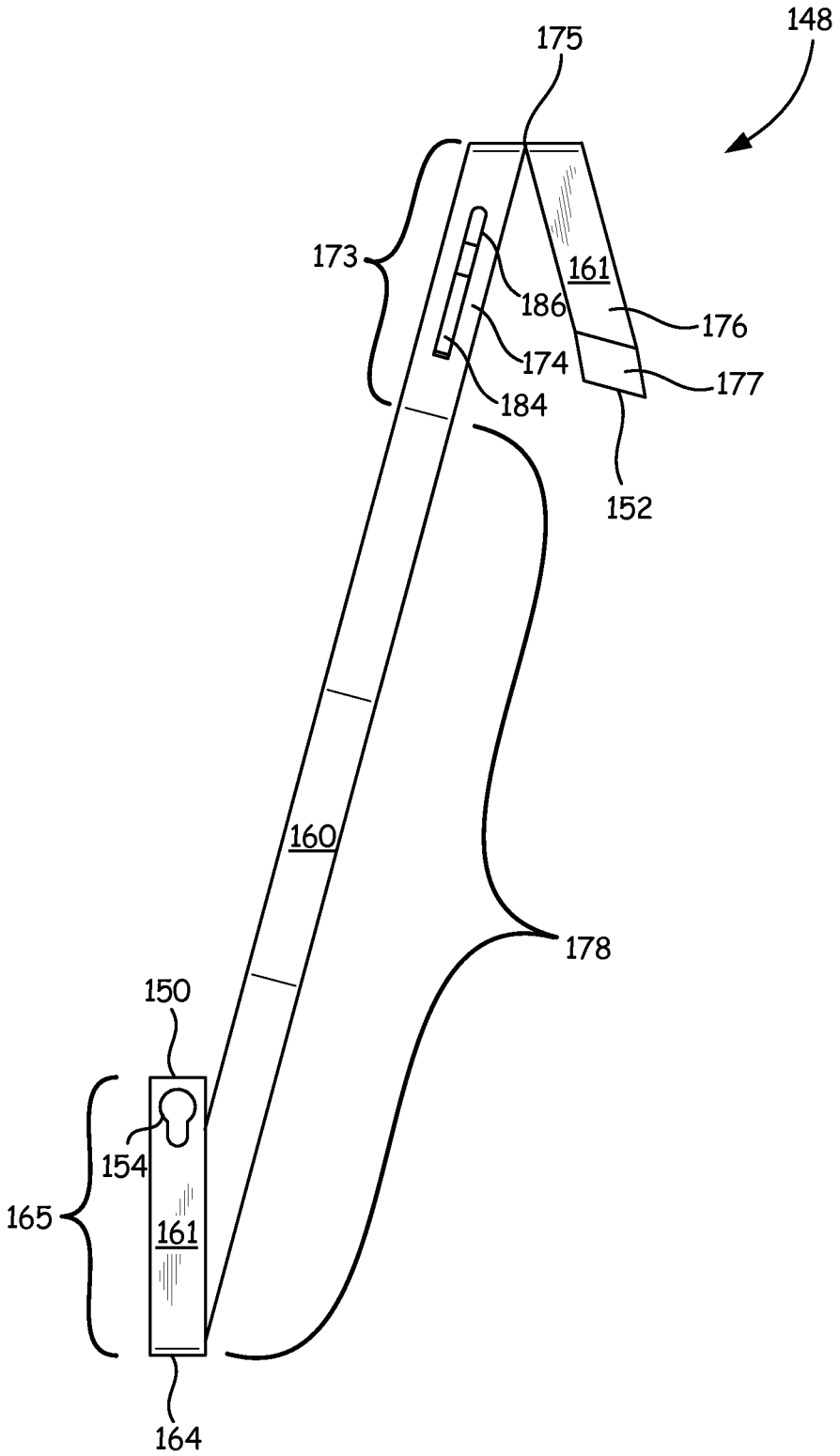
FIG. 21 is a front view of the first over-the-door hanger in FIG. 20.
Figure 22:
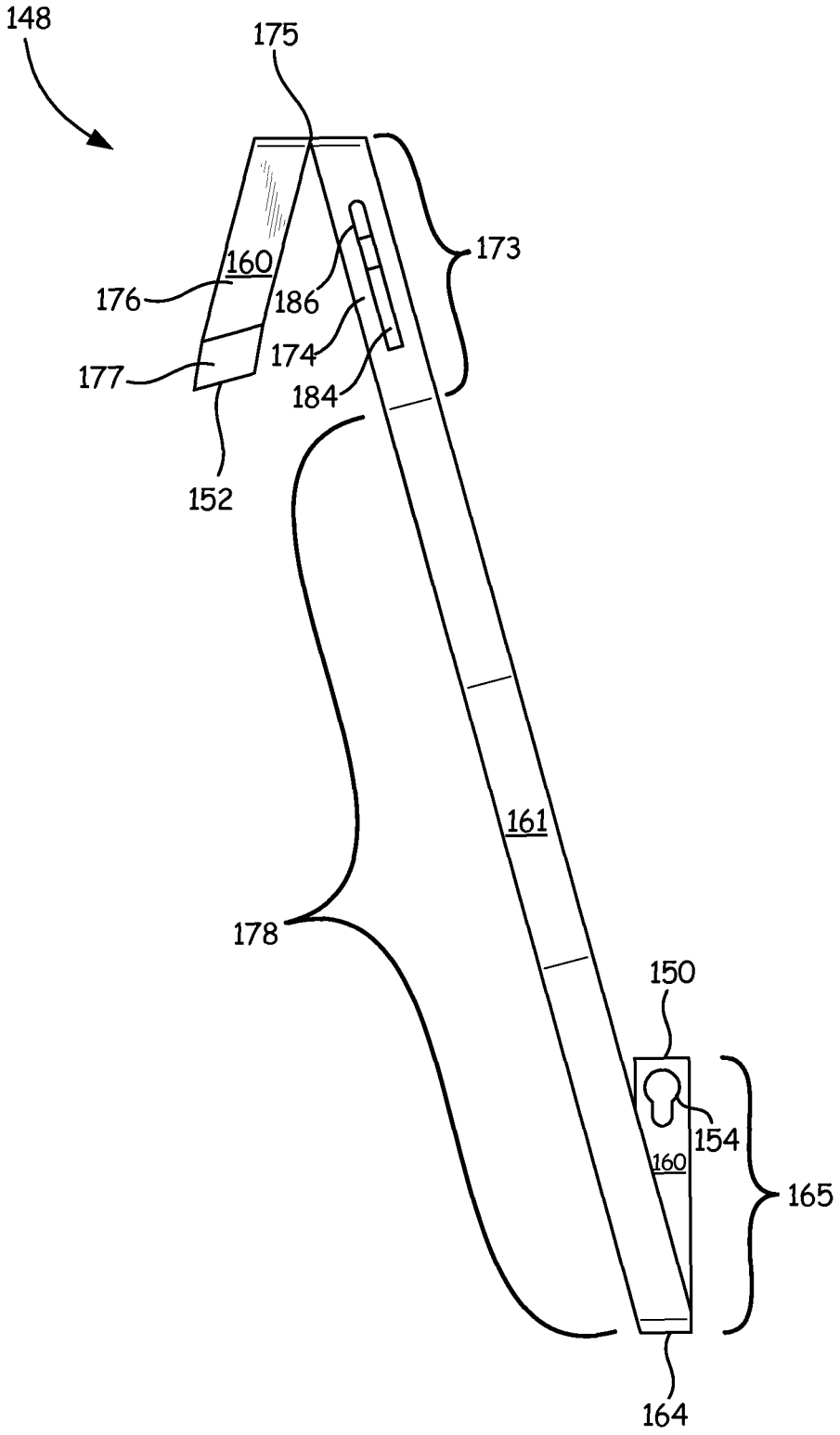
FIG. 22 is a back view of the first over-the-door hanger in FIG. 20.
Figure 23:
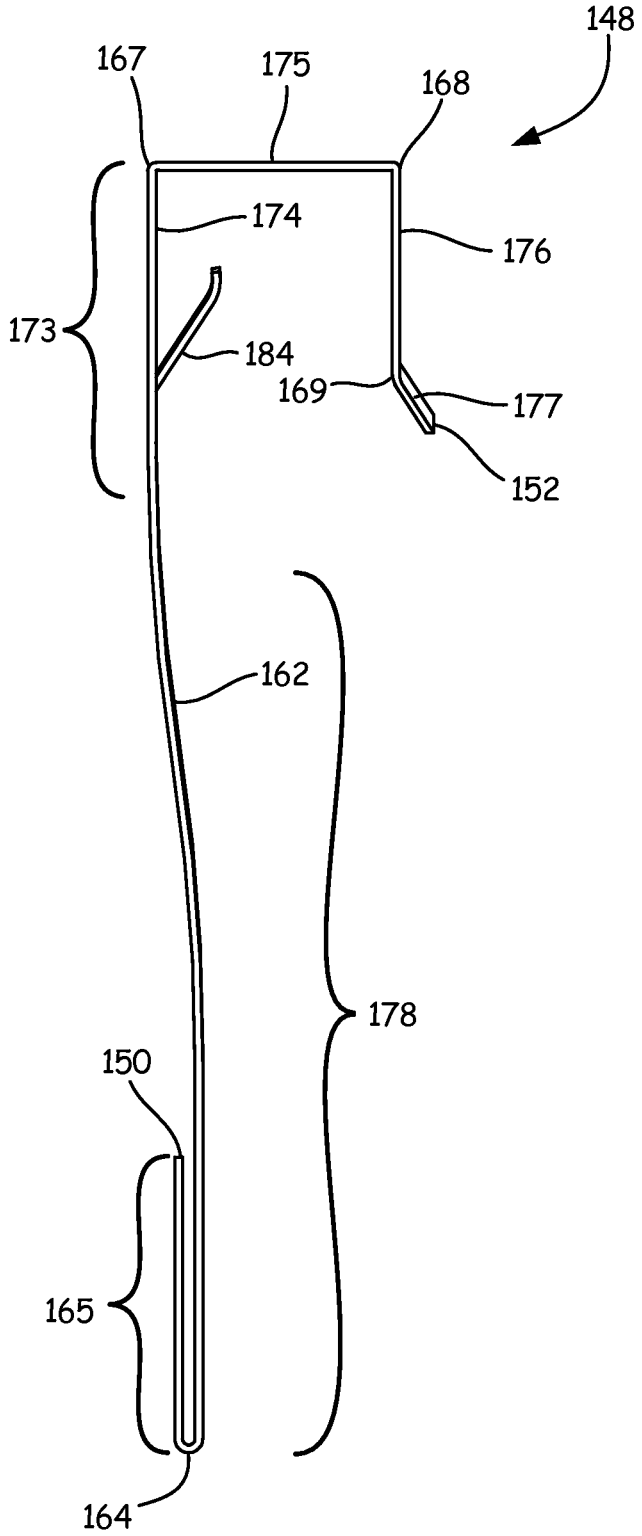
FIG. 23 is right side view of the first over-the-door hanger in FIG. 20.
Figure 24:
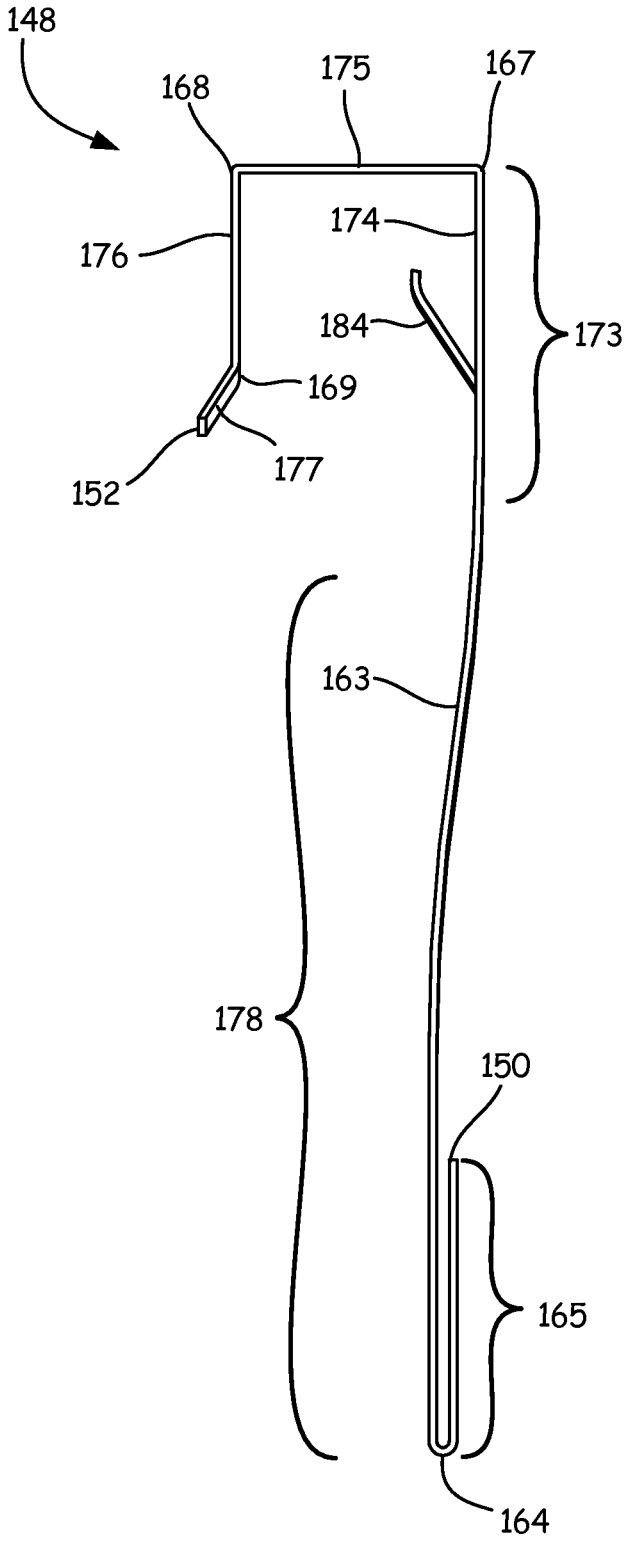
FIG. 24 is a left side view of the first over-the-door hanger in FIG. 20.

FIG. 18 is a partial section view of storage armoire 100 as indicated in FIG. 3 with latch 118 in a locked position and active portion 136 of latch 118 in its neutral state. FIG. 19 is the partial section view of FIG. 18, but with latch 118 being in an unlocked position and active portion 136 of latch 118 in its biased state. As illustrated, mirror 128 and mirror backer 130 are secured within inset 127 by inner lip 129 of inner ring 132. As also illustrated, active portion 136 of latch 118 is integrally formed with inner lip 129 of inner ring 132, which is made of a flexible material, and reactive portion 120 of latch 118 is integrally formed with base frame member 108.

While inner ring 132 is fastened to moveable base frame 126 so that inner lip 129 remains secured against mirror 128 and mirror backer 130, an engaging member 142 of active portion 136 and a handle member 144 of active portion 136 can be placed in a biased state. To place engaging member 142 and handle member 144 in the biased state and therefore unlock latch 118, a user squeezes handle member 144 against moveable base frame 126 so that engaging member 142 is rotated away from or is removed from reactive portion 120 of latch 118. When the user releases handle member 144, engaging member 142 and handle member 144 are returned back to their neutral state by the resiliency of inner ring 132. To lock latch 118, moveable frame member 126 is pushed against base frame member 108. When pushed, engaging member 142 of active portion 136 and handle member 144 of active portion 136 will flex into their biased state until engaging member 142 is past reactive portion 120 and then returns to a neutral position so that engaging member 142 again mates with reactive portion 120 of latch 118.

As illustrated in FIGS. 1-17, storage armoire 100 includes a first over-the-door hanger or elongated member 146 and a second over-the-door hanger or elongated member 148. FIG.

Figure 25:
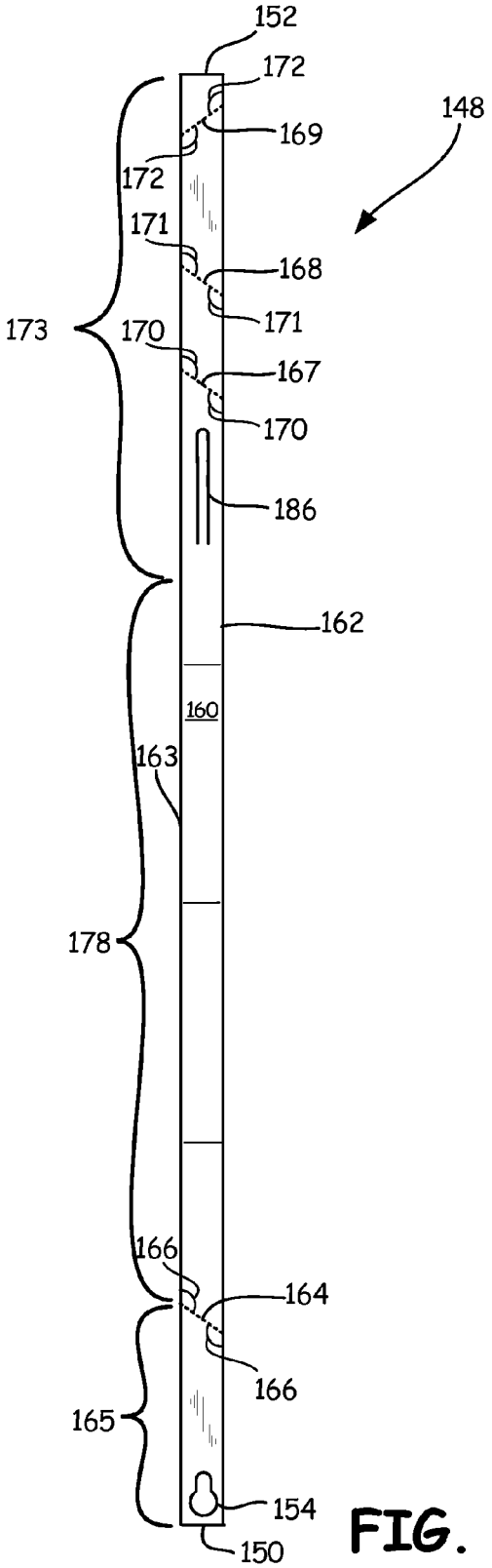
FIG. 25 is a plan view of the first over-the-door hanger in FIG. 20 in an unbent state.

20 illustrates a perspective view of second over-the-door hanger 148. FIGS. 21-24 illustrate a front view, a back view, a right side view and a left side view of second over-the-door hanger 148. FIG. 25 illustrates a plan view of an unbent or unformed second over-the-door hanger 148. First over-the-door hanger 146 is similar to second over-the-door hanger 148, but is a mirror image of over-the-door hanger 148.

In one embodiment and as illustrated in FIGS. 20-25, first and second over-the-door hangers 146 and 148 are made from a bent continuous piece of material, such as steel. Each of first and second over-the-door hangers 146 and 148 include a front surface 160, an opposing back surface 161, a first side surface 162 and an opposing second side surface 163. In an unbent configuration as illustrated in the plan view in FIG. 25, first surface 160 is substantially parallel with back surface 161, first side surface 162 is substantially parallel with second side surface 163 and first and second side surfaces 162 and 163 are substantially perpendicular to front and back surfaces 160 and 161.

Each of first and second over-the-door hangers 146 and 148 includes proximal ends 150 and distal ends 152. Proximal ends 150 are mounted to a back or back surface 109 of backer 110 of back frame assembly 102. Distal ends 152 are mounted to a door, such as door 200. To make first and second over-the-door hangers 146 and 148 into useable hangers, first and second over-the-door hangers 146 and 148 are formed by being bent, for example.

Figure 6:
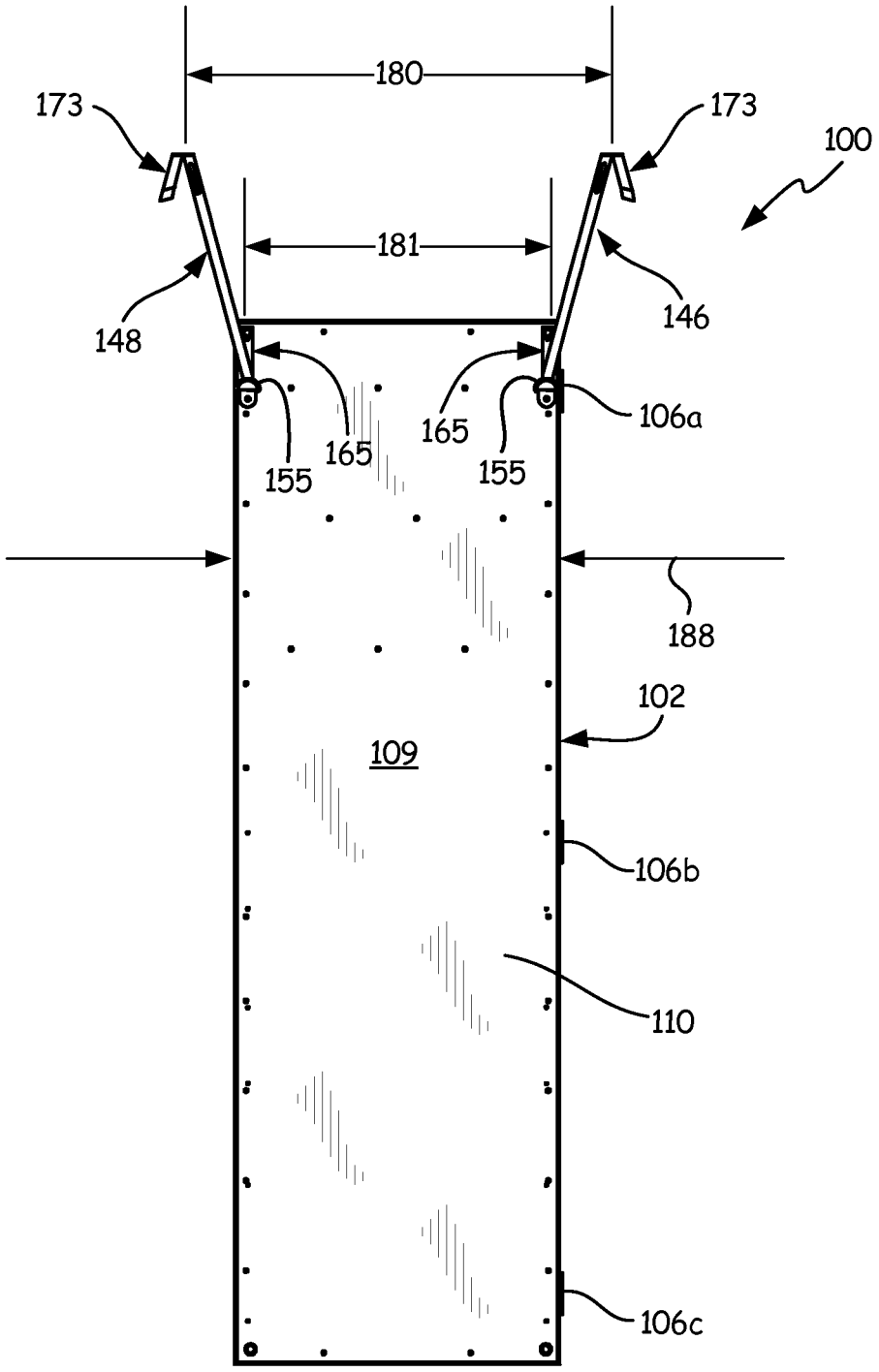
FIG. 6 is back view of the storage armoire illustrated in FIG. 1.
Figure 7:
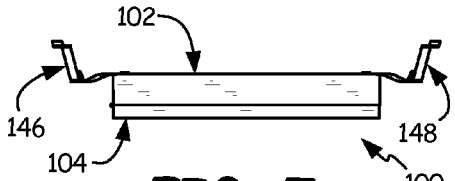
FIG. 7 is a top view of the storage armoire illustrated in FIG. 1.
Figure 8:
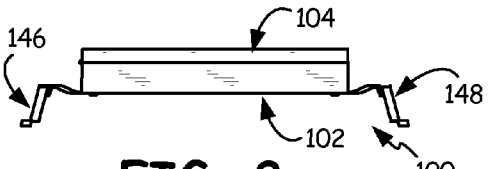
FIG. 8 is a bottom view of storage armoire illustrated in FIG. 1.
Figure 12:
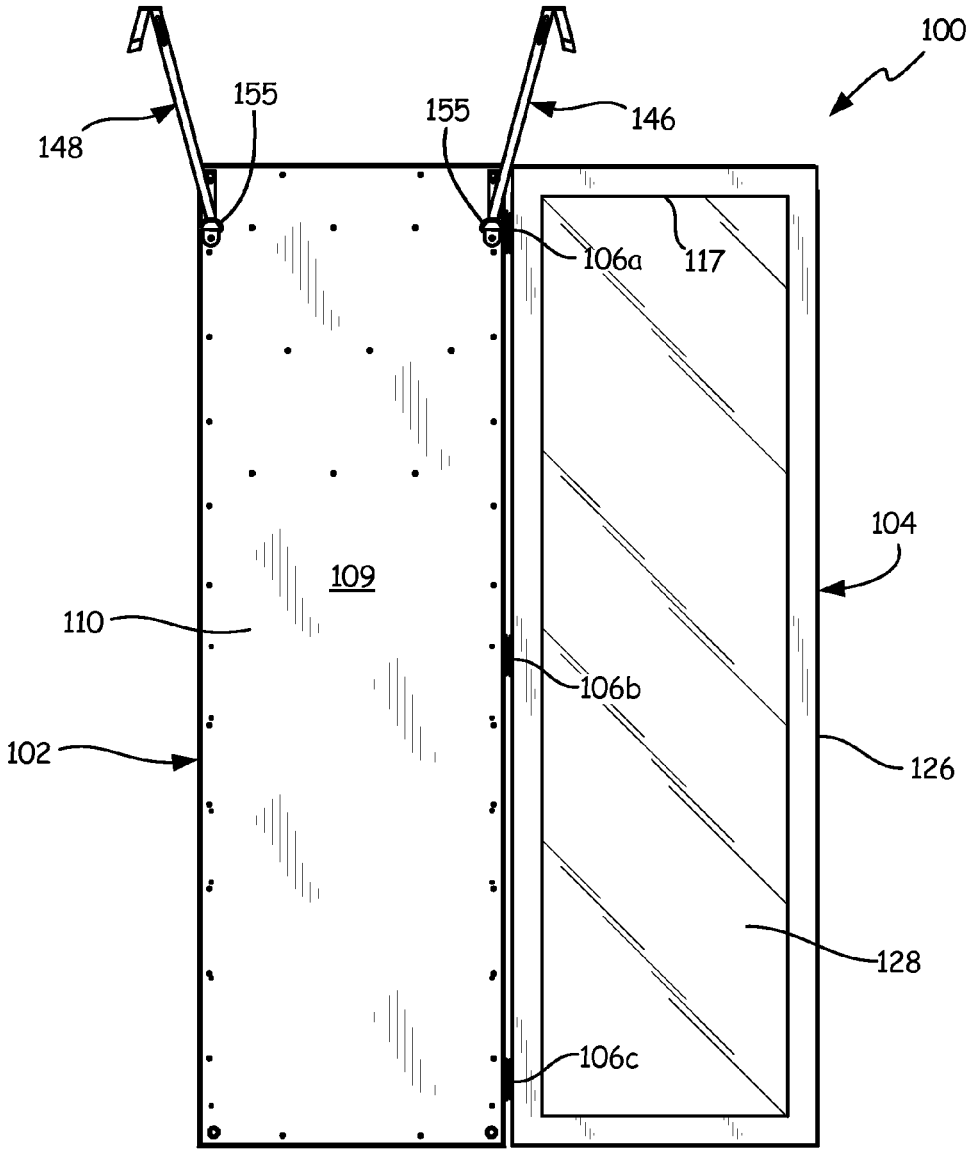
FIG. 12 is back view of the storage armoire illustrated in FIG. 2.
Figure 13:
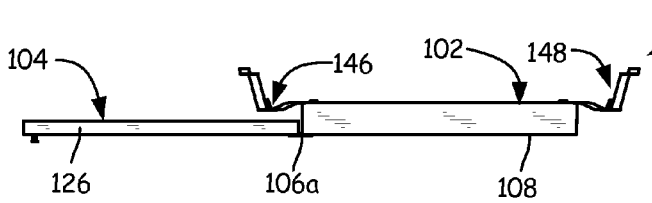
FIG. 13 is a top view of the storage armoire illustrated in FIG. 2.
Figure 14:
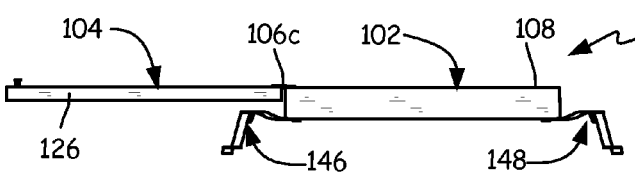
FIG. 14 is a bottom view of storage armoire illustrated in FIG. 2.
Figure 15:
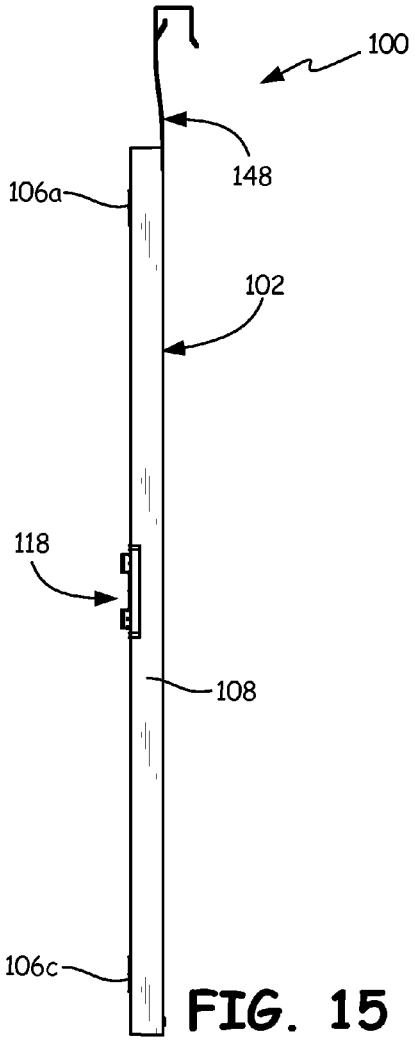
FIG. 15 is a right side view of the storage armoire illustrated in FIG. 2.
Figure 16:
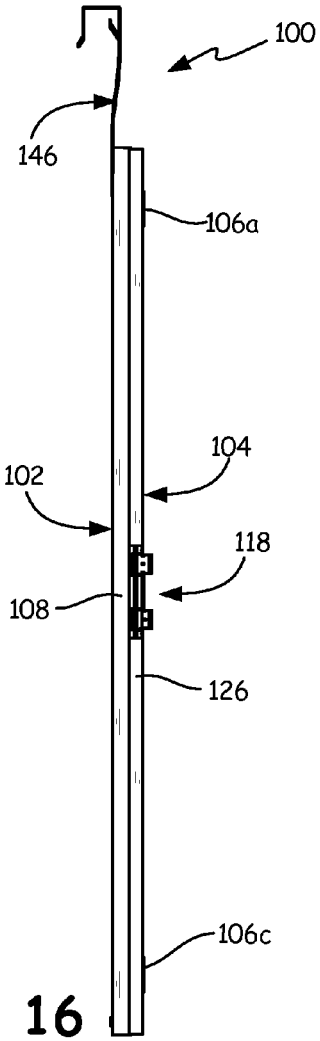
FIG. 16 is a left side view of the storage armoire illustrated in FIG. 2.
Figure 26:
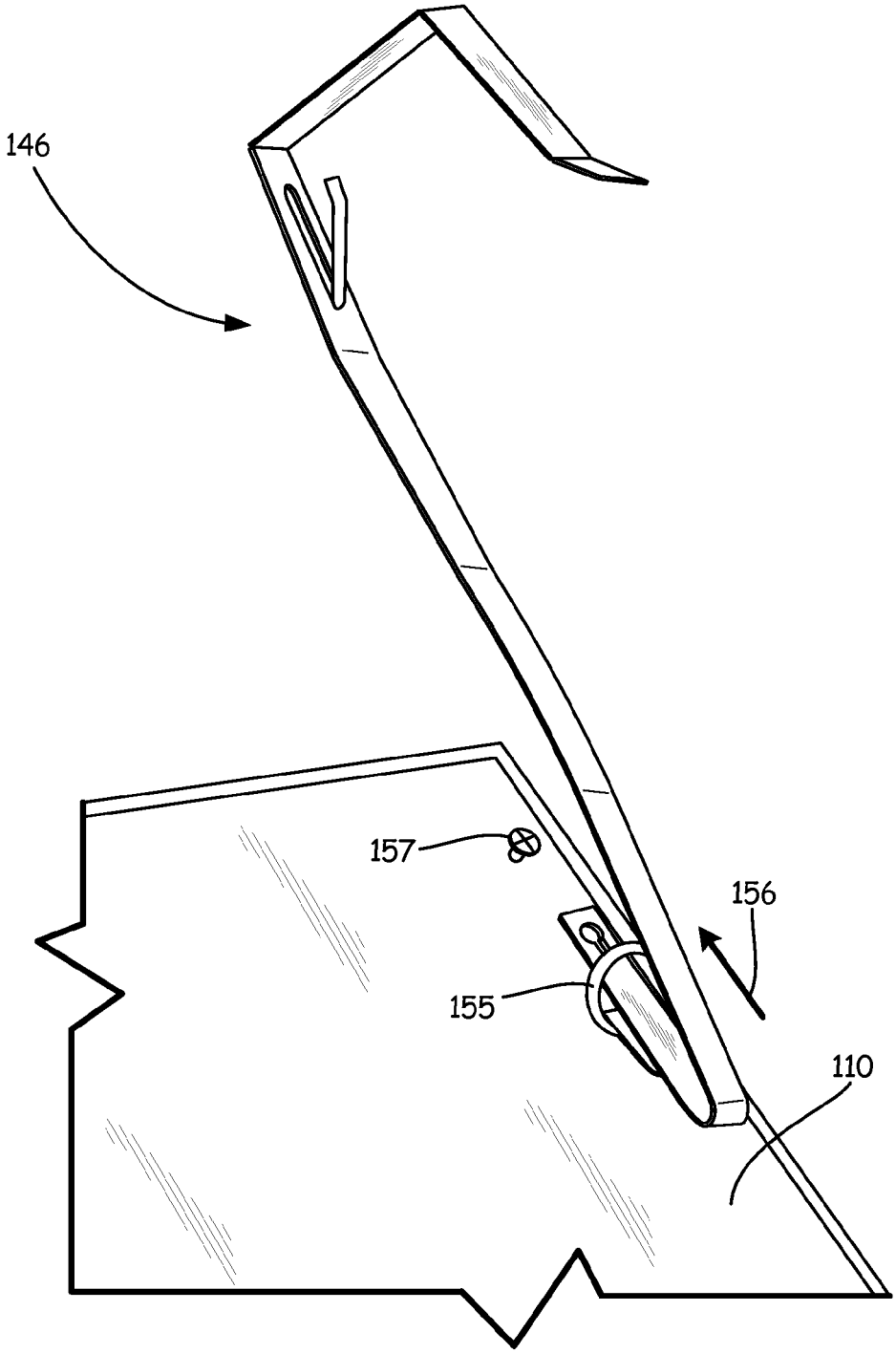
FIG. 26 is an enlarged partial perspective view of toolless mounting the first over-the-door hanger to a back of the storage armoire according to one embodiment.

Each of first and second over-the-door hangers 146 and 148 includes a mounting bend 164. Mounting bend 164 intersects with first and second side surfaces 162 and 163 of the continuous piece of material at an oblique angle 166 (FIG. 25). Defined between mounting bend 164 and proximal end 150 is a mounting portion 165. Mounting portion 165 includes a keyhole 154 and is mounted to back 109 of backer 110 of back frame assembly 102. In one embodiment, keyhole 154 provides for the tool-less mounting of mounting portion 165 to back 109 of backer 110. FIG. 26 illustrates tool-lessly mounting the mounting portion 165 of over-the-door hanger 146 to backer 110. As illustrated, a hanger ring 155 is mounted to each of a left side and a right side of back surface 109 of backer 110. Mounting portion 165 is inserted through hanger ring 155 in an upward direction 156. Keyhole 154 is mounted to a fastener 157 on back surface 109 by pressing mounting portion 165 toward back surface 109 so that fastener 157 extends through keyhole 154 and then slides mounting portion 165 further in direction 156. Ring 155 and fastener 157 together secure hangers 146 and 148 to backer 110 as illustrated in FIGS. 6 and 12.

First and second over-the-door hangers 146 and 148 also include a first hook bend 167, a second hook bend 168 and a third hook bend 169. First hook bend 167, second hook bend 168 and third hook bend 169 intersect with first and second side surfaces 162 and 163 of the continuous piece of material at oblique angles 170, 171 and 172 (FIG. 25). Together first hook bend 167, second hook bend 168 and third hook bend 169 define a U-shaped bracket or hook portion 173 of each over-the-door hanger 146 and 148.

U-shaped bracket or hook portion 173 fits over a top of a door, such as door 200. First hook bend 167 defines a front 174 of each hook portion 173. Front 174 of each hook portion 173 is placed adjacent the side of door 200 on which storage armoire 100 is to be placed. Defined between first hook bend 167 and second hook bend 168 is a top 175 of each hook portion 173. Top 175 of each hook portion 173 is placed adjacent the top of door 200. Defined between second hook bend 168 and third hook bend 169 is a back 176 of each hook portion 173. Back 176 of each hook portion 173 is placed adjacent the opposite side of door 200 from the side on which storage armoire 100 is to be placed. Defined between third hook bend 169 and distal end 152 is a flange 177 of each hook portion 173.

Extending between the mounting portion 165 and the hook portion 173 of each of over-the-door hanger 146 and 148 is an arm 178. Arm 178 determines a vertical position of storage armoire 100 on door 200. A longer arm 178 makes the storage armoire sit lower on the door. A shorter arm 178 makes the storage armoire sit higher on the door. As illustrated in FIGS. 1-17 and as indicated specifically in FIG. 6, hook portions 173 of over-the-door hangers 146 and 148 are spaced apart from each other when hung from a door at a distance 180 that is greater than a distance 181 that mounting portions 165 are spaced apart from each other. In other words, each over-the-door hanger 146 or 148 is oriented at oblique angles 182 and 183 (FIGS. 1 and 2) relative to a top of a door, such as door 200.

By having hook portions 173 be spaced apart from each other further than mounting portions 165 and over-the-door hangers 146 and 148 oriented at oblique angles 182 and 183, storage armoire 100 will not slide substantially or rotate substantially on the door (particularly when the door is open) when front frame assembly 104 is unlatched from back frame assembly 102 and opened. Mounting bend 164, first hook bend 165, second hook bend 166 and third hook bend 167 and how they are obliquely angled from first and second side surfaces 161 and 162 of the continuous pieces of material allow over-the-door hangers 146 and 148 to be placed distances 180 and 181 relative to each other and be oriented at angles 182 and 183 from the top of door 200.

More specifically, mounting bend 164 orients mounting portion 165 out of alignment from arm 178 so that mounting portion 165 is bent substantially 180 degrees from arm 178 and at oblique angle 166 relative to first and second side surfaces 161 and 162. First hook bend 167 orients top 175 of hook portion 173 out of alignment from front 174 of hook portion 173 so that top 175 is bent substantially 90 degrees from front 174 at oblique angle 170 relative to first and second side surfaces 161 and 162. Second hook bend 168 orients back 176 of hook portion 173 out of alignment from top 175 of hook portion 173 so that back 176 is bent substantially 90 degrees from top 175 at oblique angle 171 relative to first and second side surfaces 161 and 162. Third hook bend 169 orients flange 177 of hook portion 173 out of alignment from back 176 of hook portion 173 so that flange 177 is bent slightly outwards from back 176 at oblique angle 1172 relative to first and second side surfaces 161 and 162. Flange 177 facilitates placement of hook portion 173 over a top of a door by allowing a user to grip or pull on flange 177 in order assist with the placement of hook portion 173 while also preventing excessive scratching on the door. As clearly shown in FIG. 25, mounting bend 164, first hook bend 167 and second hook bend 168 are substantially parallel with each other, while third hook bend 169 is not.

Each hook portion 173 further includes a flexible tab or biasing tab 184 that protrudes from front 174 of hook portion 173 toward back 176 of hook portion 173 into a space defined by hook portion 173. In one embodiment and as illustrated in FIGS. 20-25, flexible tab 184 is integrally formed with the continuous piece of material of each over-the-door hanger 146 and 148 by, for example, a process of stamping a slot 186 in front 174. Slot 186 defines three sides of tab 184. A fourth side of tab 184 remains unstamped and is connected to the remainder of the hanger. Flexible tab 184 acts as a biasing member and secures hook portion 173 to a door regardless of the thickness of the door. In other words, using flexible tab 184, hook portion 173 can mate with varying thicknesses or different thicknesses of doors. In addition, the curved bends in arm 178 provides an additional feature for accommodating varying thicknesses of doors.

To hang storage armoire or article 100 on door 200, the mounting portion 165 of first over-the-door hanger 146 is mounted to a back 109 of storage armoire 100 such that mounting portion 165 of first over-the-door hanger 146 is located adjacent to a first side 111 of storage armoire 100. The method further includes mounting second over-the-door hanger 148 to a back 109 of storage armoire 100 such that mounting portion 165 of second over-the-door hanger 148 is located adjacent to a second side 113 of storage armoire 100. First side 111 opposes second side 113. The method further includes hanging hook portions 173 of first and second over-the-door hangers 146 and 148 over the top of a door, such as door 200. Not only is hook portion 173 of first over-the-door hanger 146 spaced apart from hook portion 173 of second over-the-door hanger 148 by distance 180, which is greater than distance 181 that mounting portion 165 of first over-the-door hanger 146 is spaced apart from mounting portion 165 of second over-door-hanger 148, but distance 180 is also greater than a width 188 (FIG. 6) of storage armoire 100.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A storage armoire comprising;

a back frame assembly configured to provide a storage space;

a front frame assembly rotatably coupled to the back frame assembly so that the front frame assembly is pivotal about a portion of the back frame assembly; and first and second over-the-door hangers each made of a single, continuous piece of material having a front, a back, a first side and an opposing second side, wherein each over-the-door hanger includes a hook portion that is configured to fit over a top of a door, a planar mounting portion mounted to a back of the back frame assembly and an arm extending between the planar mounting portion and the hook portion;

wherein the hook portions of the first and second over-the-door hangers are spaced apart from each other on the door at a distance that is greater than a distance that the mounting portions mounted to the back of the back frame assembly are spaced apart from each other;

wherein each hook portion is defined by at least two 90 degree bends where the 90 degree bends are bent along the back of the material and intersect with the first and second sides of the material at an oblique angle;

wherein each planar mounting portion is defined by a 180 degree bend where the 180 degree bend is bent along the front of the material and intersects with the first and second sides of the material at an oblique angle so that the planar mounting portion is oriented out of alignment from the arm, the oblique angles of the 90 degree bends and the oblique angle of the 180 degree bend are substantially parallel.

2. The storage armoire of claim 1, wherein when the first and second over-the-door hangers are unbent the back surface is substantially parallel to the front surface, the first side surface is substantially parallel to the second side surface and the first and second side surfaces are substantially perpendicular to the front and back surfaces.

3. The storage armoire of claim 1, wherein the planar mounting portion is oriented out of alignment from the arm and is substantially parallel to at least a portion of the arm.

4. The storage armoire of claim 1, wherein each hook portion of the first and second over-the-door hangers comprises a front, a top defined between the first and second 90 degree bends, a back and a biasing tab that protrudes from the front of the hook portion toward the back of the hook portion.

5. The storage armoire of claim 4, wherein each hook portion comprises a third bend where the third bend is bent along the front of the material and intersects with the first and second side surfaces of the material at an oblique angle so that a flange is oriented out of alignment from the back of the hook portion.

6. The storage armoire of claim 1, wherein the front frame assembly comprises an outer profile, a mirror, a mirror backer and an inner ring that attaches to an inside of the outer profile to secure the mirror and the mirror backer between the inner ring and the outer profile.

7. The storage armoire of claim 6, wherein the front frame assembly comprises an inner lip that presses against the mirror backer and an active portion of a latch that is integrally formed with the inner lip of the inner ring.

8. The storage armoire of claim 7, wherein the back frame assembly comprise a reactive portion of the latch that is integrally formed with an inner profile of the back frame assembly.

9. A storage armoire comprising:

a base frame member that defines an opening;

a moveable frame member that defines an opening and is pivotally coupled to the base frame member;

a backer attached to a back of the base frame member; and a pair of elongated members having proximal ends mounted to a back of the backer and distal ends that mount the storage unit to a door; and wherein each elongated member extends between the proximal end and the distal end and is oriented at an oblique angle relative to a top of the door to which the distal end is mounted; and wherein the distal end of each elongated member comprises a U-shaped bracket having a first portion, a second portion and a third portion that engages with the top of the door, the U-shaped bracket turns the elongated member such that an interior surface of the first portion faces an interior surface of the third portion;

wherein the proximal end of each elongated member comprises a bend that turns the elongated member to form a mounting portion having an interior surface that faces a front surface of the elongated member, wherein the bend is located at the proximal end and intersects with first and opposing second surfaces of the elongated member at an oblique angle.

10. The storage armoire of claim 9, wherein each U-shaped bracket comprises a flexible tab that allows the elongated members to engage with different doors having different thicknesses.

11. The storage armoire of claim 10, wherein each flexible tab is integrally formed with each elongated member by a process of stamping a material of each elongated member.

12. The storage armoire of claim 9, wherein the base frame comprises an integrally formed reactive portion of a latch.

13. The storage armoire of claim 12, further comprising an inner ring fastened to an inside of the moveable frame member to secure a mirror to the moveable frame member, wherein the inner ring includes an integrally formed active portion of the latch and wherein the active portion of the latch is configured to mate with the reactive portion of the latch so as to removably couple the moveable frame member to the base frame member.

14. The storage armoire of claim 9, wherein the base frame member is thicker than the moveable frame member so that the base frame member provides a storage space for holding items.

15. A storage armoire comprising:

a back component including a storage space;

a front component that rotatably couples to the back component to cover and uncover the storage space;

a first over-the-door hanger having a mounting portion that mounts to a back of the back component such that the mounting portion of the first over-the-door hanger is located adjacent to a first side of the back component, a hook portion that is configured to hang over the top of a door and an arm located between the mounting portion and the hook portion;

a second over-the-door hanger having a mounting portion mounted to the back of the back component such that the mounting portion of the second over-the-door hanger is located adjacent to a second side of the back component that opposes the first side of the back component, a hook portion that is configured to hang over the top of the door and an arm located between the mounting portion and the hook portion; and wherein the hook portions of the first over-the-door hanger and the second over-the-door hanger are spaced apart from each other on the door a distance that is greater than a distance that the mounting portions are spaced apart from each other on the back component;

wherein each hook portion is defined by at least two 90 degree bends where the 90 degree bends are bent along a back of a material of each of the first and second over-the door hangers and intersect with the first and second sides of the material at an oblique angle; and wherein each mounting portion is defined by a 180 degree bend where the 180 degree bend is bent along the front of the material and intersects with the first and second sides of the material at an oblique angle so that the mounting portion is oriented out of alignment from the arm, the oblique angles of the 90 degree bends and the oblique angle of the 180 degree bend being substantially parallel.

16. The storage armoire of claim 15, wherein the mounting portion of the first over-the-door hanger and the mounting portion of the second over-the-door hanger are tool-lessly mounted to the back of the back component.

17. The storage armoire of claim 15, wherein the hook portions of the first and second over-the-door hangers comprise flexible tabs that protrude into a space defined by the hook portions and secure the hook portions of the first and second over-the-door hangers over the top of the door regardless of a thickness of the door.

* * * * *